United States Patent [19]

Terashima

[11] 4,309,118

[45] Jan. 5, 1982

[54] DEVICE FOR CORRECTION OF MISPRINT OF A TYPEWRITER

[75] Inventor: Toshikatsu Terashima, Sakaki, Japan

[73] Assignee: Nobuyoshi Nakajima, Nagano, Japan

[21] Appl. No.: 113,452

[22] Filed: Jan. 21, 1980

[51] Int. Cl.[3] ..... B41J 29/36

[52] U.S. Cl. ..... 400/697.1; 400/301; 400/302

[58] Field of Search ..... 400/301, 302, 697, 697.1

[56] References Cited

U.S. PATENT DOCUMENTS

| | | | |
|---|---|---|---|
| 3,729,081 | 4/1973 | Ozimek | 400/301 X |
| 3,834,512 | 9/1974 | Haugen | 400/697.1 |
| 3,882,990 | 3/1975 | Genisio | 400/697.1 |
| 3,905,465 | 9/1975 | Frechette et al. | 400/697.1 X |

*Primary Examiner*—Paul T. Sewell
*Attorney, Agent, or Firm*—Oblon, Fisher, Spivak, McClelland & Maier

[57] ABSTRACT

A correction device for a typewriter is disclosed. The correction device includes a correction key which is linked to the escapement device which normally advances the carriage each time a key is depressed. The correction key disengages the escapement device so that the carriage is not advanced during correction of a misprinted character. Therefore, it is not necessary to backspace following the correction of the character. The correction key also causes the correction ribbon to be raised to the printing position so that it can be easily seen whether that portion of the ribbon has been used.

4 Claims, 11 Drawing Figures

DEVICE FOR CORRECTION OF MISPRINT OF A TYPEWRITER

BACKGROUND OF THE INVENTION

1. Field of the Invention

The invention relates to a misprint correction device of a typewriter.

2. Description of the Prior Art

In response to the public desire to have a mistype correction device on a typewriter, misprint erasing ribbons have appeared in market recently which have a half of their width constituting a black inked part and the other half constituting an erasing part coated with white powder of superior adhesibility, (hereinafter this part is referred to as the white part). However, these ribbons have had the disadvantage that the application of the ribbon to correct a misprint requires a rather complicated operation procedure for a typist, and mishandling often leads to further misprints. The procedure typically is as follows:

I. Move the carriage to bring misprinted position to the typing position.

II. Move the ribbon selector to bring the white portion of the ribbon in the service condition.

III. Print the same letter as was mistyped to erase the misprinted letter.

IV. Press the back spacing key to place the erased part in the printing position because typing causes the carriage to shift one letter space.

V. Operate the ribbon selector to make the black inked part return to the printing position.

VI. Type the correct letter to finish the correction.

Because the portion of an erasing ribbon once used cannot be reused, the portion of the ribbon is typically checked before printing, to be certain that it has never been used before. However, most of the conventional typewriters are devised to shift the ribbon only when the machine is operated for typing. Therefore, there is a fear that when an unused portion of a ribbon is seen near to the printing position before printing, that the once used portion would be subjected to the printing position when actually typed. Therefore a certain long range of the unused part is kept reserved at the portion next to typing position, resulting in a very uneconomical increasing of tape consumption.

A misprint corrector of a typewriter to simplify above described procedures was proposed recently which employs a special key solely used for erasing having a flat surface to cover any letters contained in the typewriter, and only by the operation of this type bar is erasure typing performed by an erasing ribbon regardless of the position of the ribbon selector. This is performed without shifting the carriage by use of a disconnecting engagement of the escapement mechanism which otherwise shifts the carriage for a space of a letter, thereby causing carriage not to be shifted.

In this method, however, a mechanism which can more strongly press the erasing type is required. Because of the large printing surface of the correction key requiring larger pressure to erase a misprinted letter, and the use of the same mechanism as with other typing mechanisms, typing becomes difficult, or requires very large effort to bring the type surface and printing paper surface to uniformly meet together. There is also a strong fear that a part of the sides of the neighboring letters may be erased in performing an erasing type for a letter because the erasing type covers very close to adjacent up and down or left and right elongated letters. Further, the problem of requiring a larger portion of the erasing ribbon to be unused still remains.

Prior to explaining the structure of the invention in accordance with an illustrative example shown in the drawings, in order to make easy the understanding of the invention, the structure and operation of the key point of a conventional typewriter already known and related directly to this invention is explained as follows. In FIG. 1, element 2 is a universal ribbon lever pivotally supported to the machine frame 1 on a shaft 1'. A side beam 3, which is installed horizontally to the lever 2, causes lever 4 which is connected to type key to move rotatively in the direction of arrow $X_1$. Movement of any one of the type keys causes a type lever (not shown in the drawing) to move rotatively to print a letter. The type lever is connected to a lever 4 by a wire rod 5 connected to the edge of the lever 4. The lever 4 contacts side beam 3 and causes the beam 3 to rotate as shown by arrow $X_2$ around the shaft 1'. The lever 2 is connected to a wire 8 which operates ratchet mechanism 7 which intermittently rotates a ribbon reel 6' of ribbon winder 6, and causes the ribbon reel 6' to rotate intermittently due to rotational movement of the lever 2 as a letter is printed. As a result ribbon 9 is wound up for the length corresponding to one letter width.

In FIG. 1, element 10 is an escapement mechanism which is fixed to a part of the carriage 11 which (see FIG. 10 and FIG. 11) is supported to rotate freely, as shown enlarged in FIG. 4. Escapement wheel 14 is fixed on the shaft of pinion 13 which meshes with rack 12 which is always pulled in the direction of arrow X. Lever 17, an end of which is formed with a holding pawl 15 acts against the escapement wheel 14 and has projected piece 16 at the other end and is pivotly supported to the machine frame by shaft 18. Lever 23, to which shifting pawl 20 is separately installed on arm 19 thereof and having hooking holes 22 for coil spring 21 at the other end, is also pivotally supported by said shaft 18. In opposition to the lever 23, a swing lever 25 having hooking holes 24, which engages with coil spring 21 suspended between it and hooking hole 22, is supported pivotally by pin 26. Projected piece 16 of lever 17 engages with projection 27 of swing lever 25. Lever 23 is pulled towards swing lever 25 by coil spring 28. Lever 17 is pulled by coil spring 29 to cause the holding pawl 15 to always tend to go in between the teeth of lever 23.

The escapement mechanism 10 is further equipped with an operation mechanism 31 which pivotly supports swing board 32 by a pair of brackets $32_1$ and $32_2$ fixed to the machine frame about axis 330 as shown enlarged in FIG. 5. An adjustable screw lever 33 is screw attached to the free end of swing board 32, and the top of said screw lever 33 is made to contact to the under face of the arm 19 of lever 23 of the escapement mechanism 10. Against the other free end 34 of swing board 32, pressing lever 35 which presses free end 34 of said swing board 32 of said operation mechanism 31 when a user is pressing any type key or spacing key is installed as shown in FIG. 6. Therefore, pressing any type key or spacing key causes pressing lever 35 to move in the direction of arrow-Y, which presses the free end 34 of swing board 32 of operation device 31 of escapement mechanism 10 to rotate swing board 32 in the direction of arrow-Z. This makes adjusting screw lever 33 rotate arm 19 of lever 23 of escapement mechanism 10 in a counterclockwise direction in FIG. 4, which rotates lever 17, via projection 27 of swing lever 25, which in turn moves with said lever 23 as one body in a counterclockwise direction. Holding pawl 15 then disengages from the escapement wheel while shifting pawl 20 meshes with the escapement wheel which causes escapement mechanism 10 to move carriage or platen 11 for one letter space. The swing plate 32 will be returned to the original position by return spring 28. Backspacing key 36 is shown in FIG. 1.

SUMMARY OF THE INVENTION

The object of this invention is to offer a typewriter misprint correction mechanism eliminating the above stated deficits.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figures 1, 2:
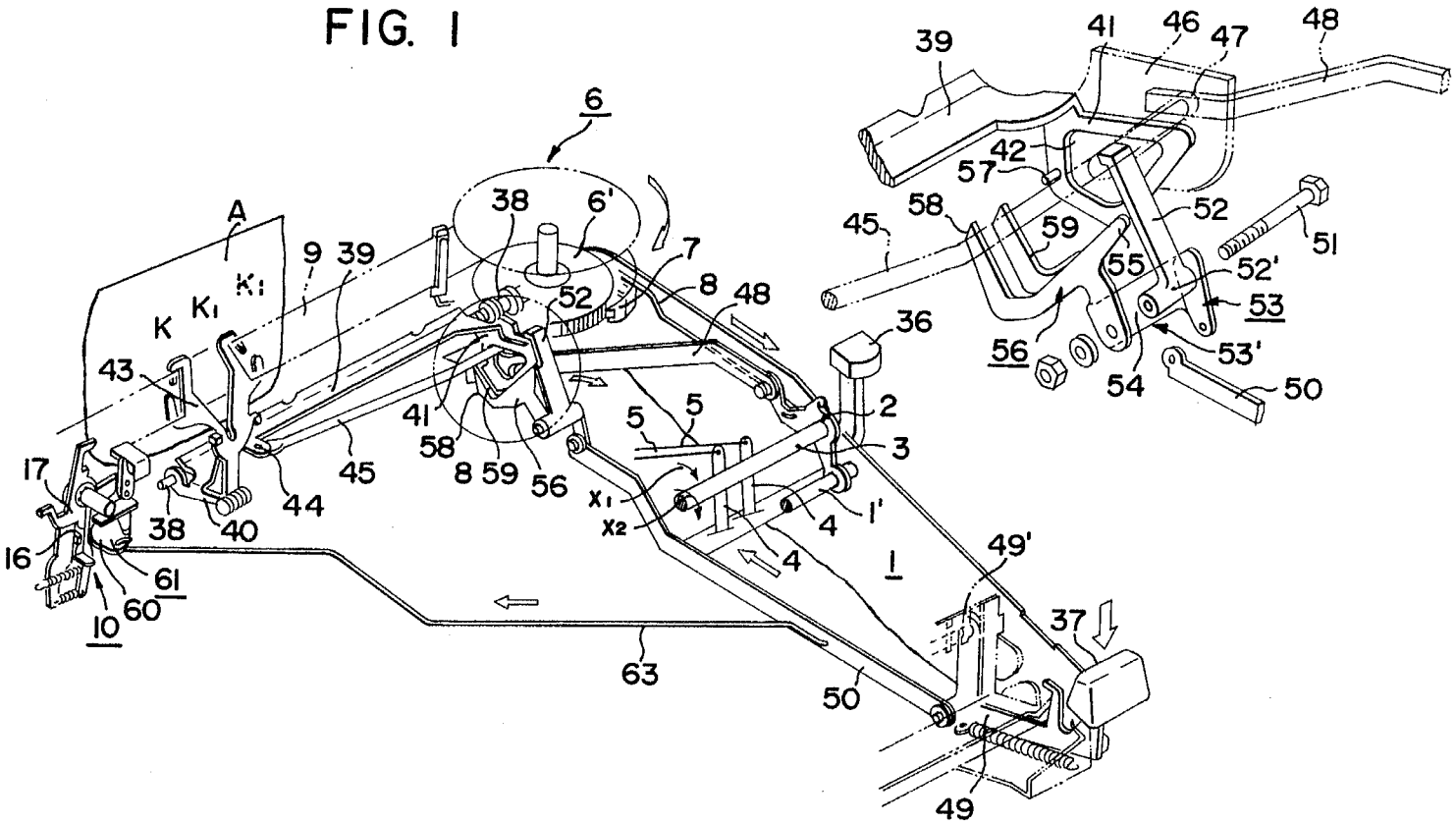
FIG. 1 is a perspective view of the linkage of the invention.
FIG. 2 is an enlarged exploded perspective view of the portion indicated in the circle in FIG. 1.
Figure 3:
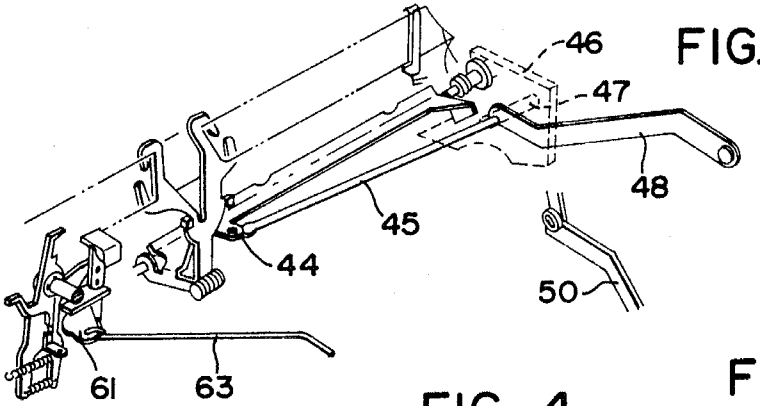
FIG. 3 is a perspective view of the relation of rod lever and guide channel.
Figure 5:
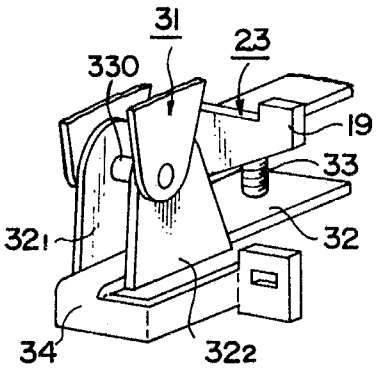
FIG. 5 is an enlarged perspective view of the operation device.

A mechanism of an illustrative example of this invention is described in the following. The apparatus includes at least one universal ribbon lever 2 for the operation of ribbon winding device 6 which intermittently shifts ribbon 9, back spacing key 36 which can shift back platen 11 on the carriage to a misprinted position, and print correction key 37. A prepare shaft 38 is horizontally installed on the machine frame to the lower side of the area where correction ribbon 9 extends. A pivotally installed band plate 39 is held parallel to the shaft 38 by arms 40 and 41 depending from both sides of the plate 39. Ribbon holder 43 is pivotally attached to the free end of an arm 40 and through-hole 42 occurs in the other arm 41 (see FIG. 2), through which extends the other end of rod lever 45 which is pivotly supported to a part 44 of the band plate 39. Rod lever 45 extends through said through-hole 42 and guide channel 47 prepared in plate 46 which is projecting from the machine frame and connected to the other end of the connecting lever 48 connected to the free end of the said universal ribbon lever 2.

Figure 7:
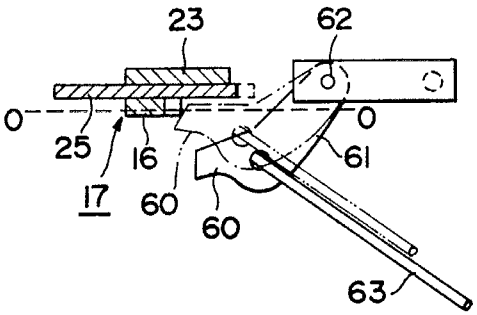
FIG. 7 is a transverse cross section along line 7—7 in FIG. 4.
Figure 10:
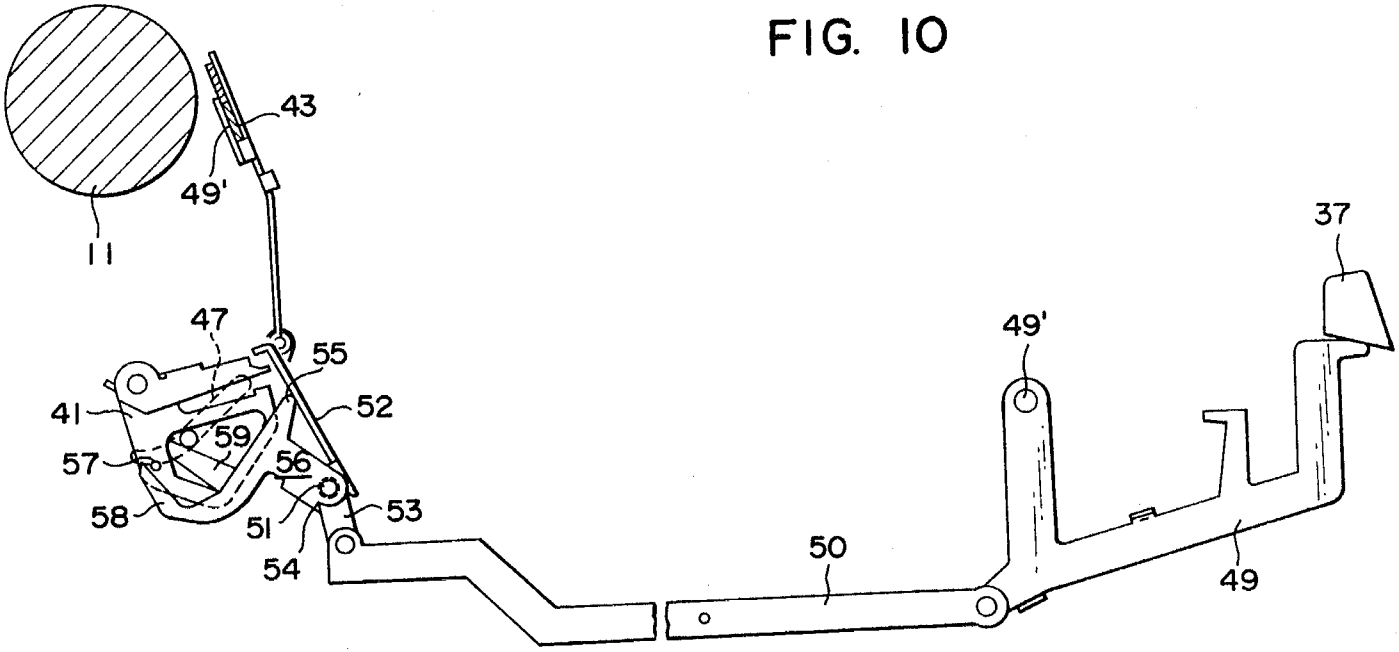
FIG. 10 and FIG. 11 are explanatory drawings of the operation of the mistype correction key.
Figure 11:
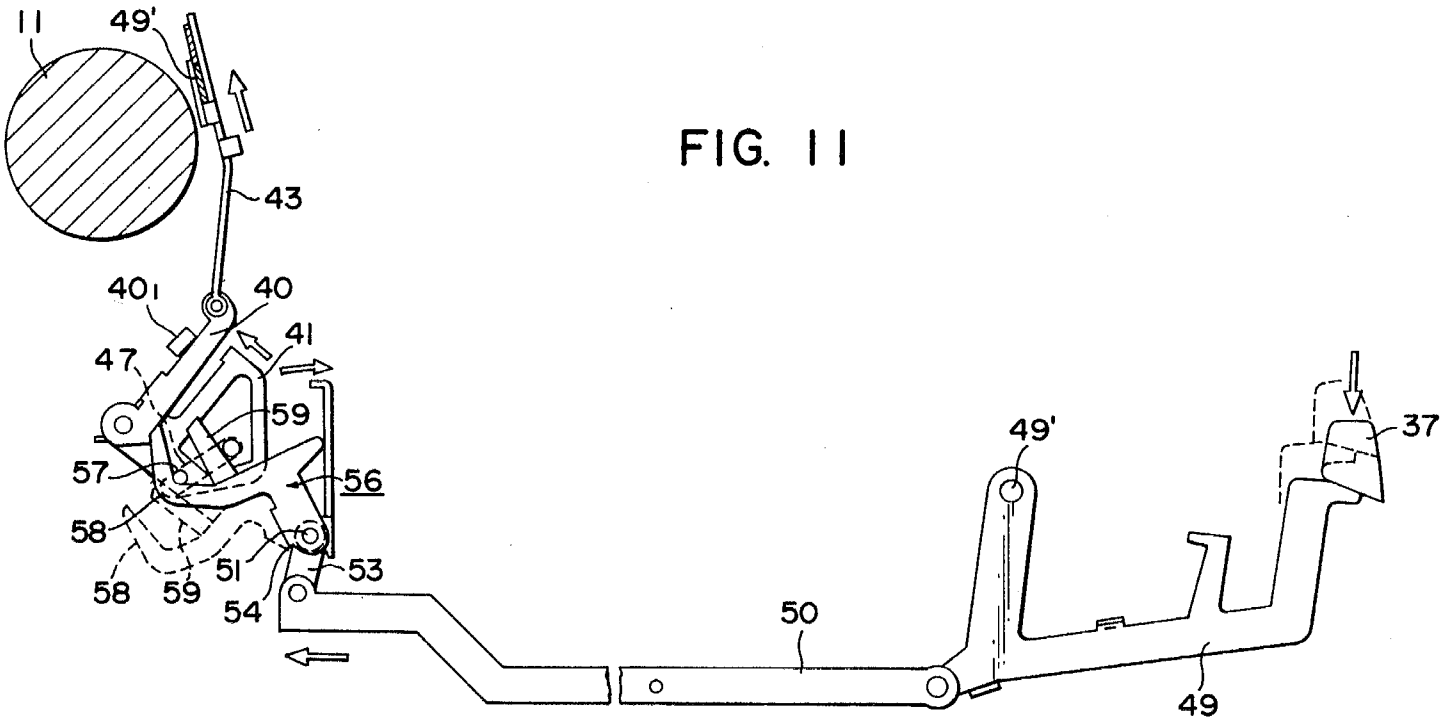

Misprint correction key 37 is installed to one end of lever 49 which is pivotly attached to the machine frame by pivot 49' as shown in FIG. 10 and FIG. 11. The other end of the lever 49 is connected to arm 53 which is a part of swing piece 56 pivotly supported by shaft 51 installed separately to the machine frame through link 50 (see FIG. 2). The swing piece 56 is prepared with a first projection piece 58 which can engage with pin 57 projectingly installed on said arm 41 and second projection piece 59 which can be engaged with said rod lever 45 and a further projection piece 55. A pivoting portion of the shaft 51 is passed through a bent channel section form of which one end is formed into said arm 53 and the hub part 52' of the stopper 52 is accommodated within channel form bent portion 53' and pivotly attached to shaft 51. The swinging piece 56 and hub 52' of stopper 52 are connected by torsion spring 54 to make the stopper 52 always contact with said projection piece 55 of the swing piece 56. In escapement device 10, lever 61 having projection portion 60 is pivotly supported to the machine frame by pin 62 so that it can move in and out of rotating trace o-o (see FIG. 7) of projected piece 16 of the lever 17 having holding pawl 15. The free end of the lever 61 and link 50 which is connected to lever 49 of said misprint correction key 37 are connected by wire 63 as shown in FIG. 1. Piece 40 in drawing 11 is a stopper for swing arm piece $40_1$.

In this illustrative example, being constructed as described above, when a misprinted letter, for example the letter k, was printed as shown in FIG. 1, the platen has already shifted to the left for one letter space from the printing position A. Back spacing key 36 will then be pressed down to return to misprinted k and to the printing position A. (The returned misprint k is expressed temporarily as $k_1$.)

Then, when misprint correction key 37 is pressed down, link 50 operates through rod 63 and causes projection 60 of lever 61 to project into the rotational moving trace o—o of projected piece 16 of lever 17 including holding pawl 15 of escapement mechanism 10. Therefore holding pawl 15 does not disengage from the teeth of escapement wheel 14 and escapement mechanism 10 is kept inoperative.

On the other hand, depression of correction key 37 causes swing piece 56 connected to the key 37 through link 50 to rotate clockwise in FIG. 10, and brings the swing piece to the state as shown in FIG. 11. Stopper 52 which is biased to touch projected piece 55 by torsion spring 54 also rotates clockwise around the shaft 51 as the rotating center and allows counterclockwise rotation of arm 41. Then first projecting piece 58 of swing piece 56 picks up pin 57 of arm 41, moves arm 41 in a counterclockwise direction and causes the other arm piece 40 of band plate 39 to turn counterclockwise. This raises ribbon holder 43 upwards and holds the white part 49' of the ribbon at the height of misprinted letter $k_1$. Because arm piece 40 is limited to a certain position by stopper $40_1$, the white part 49' of the ribbon is accurately held at the correcting position. Then, pressing of the misprinted key causes it to type through the white part of the ribbon and the misprinted letter is erased out. However, the platen stays unmoved during this period and correct typing after freeing the correction key 37 will complete the correction.

Therefore, the illustrative embodiment is related to an invention having the conception of a misprint correction device of a typewriter which has a universal ribbon lever 2 which operates a ribbon winding device 6 which intermittently operates the typing key and shift misprint correction ribbon 9, and a back spacing key mechanism 36 which can shift back the platen 11 on the carriage to a misprinted portion and a misprint correcting key 37. The depression of the misprint correction key 37 makes the escapement mechanism 10 of said carriage inoperative as well as to make ribbon holder 43 raise ribbon 9 so that its white portion is placed in the printing position and the upward motion brings the universal lever 2 into operation.

Because the invention has the above construction and operation, a misprint correction procedure will only require:

I. Shifting back the misprinted portion to the printing position by depressing the key of the back spacing key device 36.

II. Striking the misprinted letter key while keeping misprint correction key 37 depressed, and releasing the misprint correction key 37.

III. Then typing the correct letter type.

The operation is quite simple and the white part of the ribbon can be confirmed as unused when typing for erasing because the misprint correction ribbon 9 is already shifted upward before typing the misprinted letter for correction. Should a used portion appear at the printing position A, an unused white portion can be shifted to the printing position by repressing the key 37. Also, ribbon holder 43 can be lifted sufficiently high so that there is no need of an actuating ribbon selector.

Figure 4:
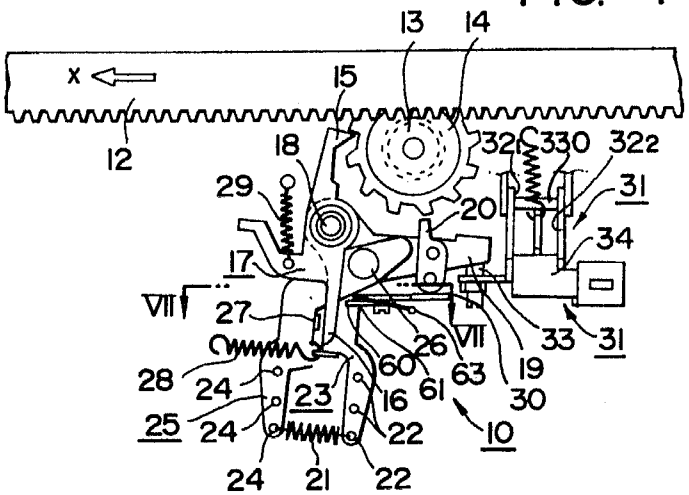
FIG. 4 is a front view of the escapement device viewed from the key side of a typewriter.
Figure 6:
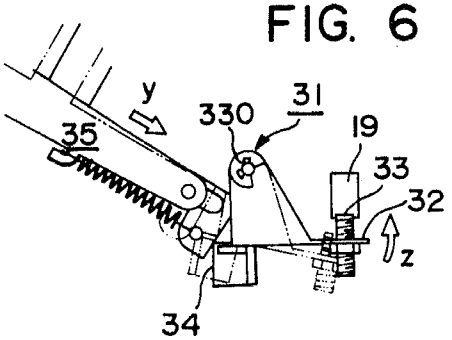
FIG. 6 is an explanatory drawing indicating the relation of the operating device and the pushing lever which operates the operating device.
Figure 8:
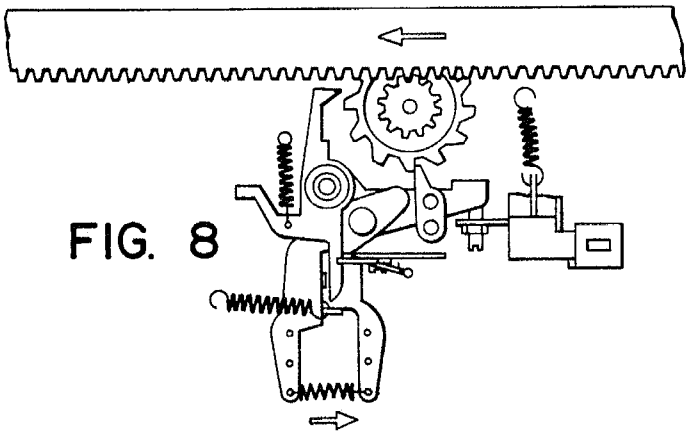
FIG. 8 is an explanatory drawing of the escapement mechanism.
Figure 9:
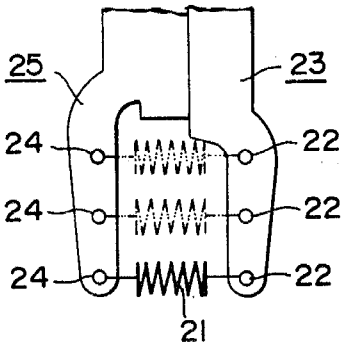
FIG. 9 is an enlarged drawing of the lower parts of the escapement mechanism.

In a second aspect of the invention, it is devised to reduce the printing pressure only in the case of a misprint correction. While normal printing requires the movement of side beam 3 of the ribbon universal lever 2, which adds much to the load, in case of a misprint correction, ribbon holder 43 is already raised up to the printing position by the depression of misprint correction key 37. Therefore, side beam 3 is already apart from the lever 4 and the load of the side beam will not act upon it. Consequently, the impact of the misprint correction becomes too strong if proper consideration is not given to this point. On the other hand, because an erasing tape is made by coating fine powder on a base (tape), and if pressed by the same pressure as usual in printing, erasing results will be rather poor because the fine powder scatters around and is not placed well on the misprinted letter. Therefore it is necessary to reduce the impact force for the correction printing. By use of the escapement device 10 as described, depression of the misprint correction key 37 will cause lever 17 which has holding pawl 15 to be stopped of its rotation by projection part 60 of lever 61. However, when correcting a letter, pressing the key for the misprinted letter lever 35 shown in FIG. 6, will cause the misprint to be pressed out as follows. Swing board 32 rotates to rotate arm 19 of lever 23 by adjusting screw 33, the rotative movement of this arm 19 is performed against the elastic force of a coil spring 21 because lever 17 having the holding-pawl 15 cannot move as it is being suppressed by projection 60 of the lever 61. This causes printing impact for erasing to be reduced at the white portion of the ribbon, resulting in proper force for the erasing of the misprint. Consequently, if a number of hooking holes 22 and 24 for the hooking of coil spring 21 are prepared at the lower end of lever 23 and 25 as shown in FIG. 4 and FIG. 9, printing impact for the misprint erasing can be adjusted to the extent most proper to the platen, resulting in a clear erasing effect.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A correction device for a typewriter including a carriage, movable by an escapement mechanism, a ribbon having a correction portion, a ribbon winding device operable by the actuation of a type character key to intermittently shift the portion of said ribbon which is in a printing position, holder means to move said ribbon into a printing position, a ribbon lever connected to said ribbon winding device for moving said ribbon winding device in response to said key, and a back spacing key adapted to return said carriage to a position wherein a misprinted character is in a printing position, said correction device comprising:

a correction key operatively connected to said escapement mechanism so as to make said escapement mechanism inoperative and operatively connected to said ribbon holder means to raise said ribbon holder means and to operate said ribbon lever, wherein said keys print with a predetermined pressure and including means for reducing the printing pressure for said correction printing.

2. The device of claim 1 wherein said means for reducing the printing pressure for said correction printing is operatively connected to said correction key.

3. The device of claim 2 wherein said means for reducing the printing pressure for said correction printing includes said escapement mechanism.

4. A correction device for a typewriter including a carriage, a ribbon having a correction portion, a ribbon winding device operable by the actuation of a type character key to intermittently shift the portion of said ribbon which is in a printing position, holder means to move said ribbon into a printing position, a ribbon lever connected to said ribbon winding device for moving said ribbon winding device in response to said key, and a backspacing key adapted to return said carriage to a position wherein a misprinted character is in a printing position, said correction device comprising:

a misprint correction lever;

a movable swing piece including a first projection and a second projection;

a first connecting lever connecting said misprint correction lever and said swing piece for the movement of said swing piece;

a rotatable band plate having a first arm including a pin engageable with said first projection whereby said band plate is rotated by said swing piece;

a swing arm pivoted to said band plate and to said ribbon holder means for moving said ribbon into a printing position in response to the rotation of said band plate;

a second connecting lever pivotally connected to said ribbon lever; and a rod lever pivotally connected to said band plate and joined to said second connecting lever, said rod lever being actuated by said second projection of said swing piece, whereby said ribbon lever is moved by the movement of said swing piece.

* * * * *

UNITED STATES PATENT AND TRADEMARK OFFICE

CERTIFICATE OF CORRECTION

PATENT NO. : 4,309,118

DATED : Jan. 5, 1982

INVENTOR(S) : Toshikatsu Terashima

It is certified that error appears in the above—identified patent and that said Letters Patent is hereby corrected as shown below:

On the title page, add Item [30] to read:

[30]---Foreign Application Priority Data

Jan. 22, 1979 [JP] Japan ..... 54-4869

Signed and Sealed this

Ninth Day of March 1982

[SEAL]

Attest:

GERALD J. MOSSINGHOFF

Attesting Officer

Commissioner of Patents and Trademarks